US005815839A

United States Patent [19]

Safford

[11] Patent Number: 5,815,839

[45] Date of Patent: Oct. 6, 1998

[54] FLEXIBLE WEAR-RESISTANT GLOVE

[76] Inventor: Kenny Safford, 21354 Nordhoff St. #105, Chatsworth, Calif. 91311

[21] Appl. No.: 977,677

[22] Filed: Nov. 24, 1997

[51] Int. Cl.[6] ..... A41D 19/00

[52] U.S. Cl. ..... 2/161.1; 2/163; 2/169

[58] Field of Search ..... 2/159, 161.1, 161.2, 2/161.6, 163, 169, 16, 20

[56] References Cited

U.S. PATENT DOCUMENTS

| | | | |
|---|---|---|---|
| 1,525,224 | 2/1925 | Charney | 2/169 |
| 1,540,718 | 6/1925 | Sturm | 2/163 |
| 1,620,643 | 3/1927 | Gillian | 2/169 |
| 1,822,010 | 9/1931 | Cecil | 2/169 |
| 1,893,394 | 1/1933 | Bondy | 2/159 |
| 2,434,044 | 1/1948 | Levine | 2/169 |
| 2,538,837 | 1/1951 | Johnston | 2/169 |
| 2,860,347 | 11/1958 | Collins | 2/169 |
| 3,548,414 | 12/1970 | Fujita | 2/169 |
| 5,581,809 | 12/1996 | Mah | 2/161.1 |
| 5,640,712 | 6/1997 | Hansen et al. | 2/161.1 |

*Primary Examiner*—Amy B. Vanatta
*Attorney, Agent, or Firm*—Erik M. Arnhem

[57] ABSTRACT

A glove, designed for use by bicyclists, has a front panel of wear-resistant material, a somewhat thinner panel of wear-resistant material, and a rear panel of open weave net material. Elongated finger sections of the second panel have sinuous side edges that promote flexibility of the glove finger sections. Resilient pads on rear surfaces of the finger sections provide protection against cuts and bruises. A circular cushion on the palm area of the glove body absorbs and distributes pressures that are transmitted to the hand surface when the wearer exerts a gripping force on a bicycle handlebar during normal bicycle riding activity. The glove has an advantageous combination of features, including good flexibility, wear resistance, ventilation, and abrasion protection.

18 Claims, 3 Drawing Sheets

FLEXIBLE WEAR-RESISTANT GLOVE

BACKGROUND AND SUMMARY OF THE INVENTION

This invention relates to a glove, and particularly to a flexible wear-resistant glove adapted to be worn by a bicyclist, i.e. a person sitting on his or her bicycle with hands gripping the bicycle handlebars. Although the glove is especially designed for use by bicyclists, the glove can also be worn by any person where glove flexibility and wear-resistance are important considerations. For example, the glove of the present invention can be worn on the hands of baseball players and golfers.

Conventional gloves are usually a compromise between flexibility and wear-resistance. Gloves formed of a thin flexible material often lack wear-resistance. Gloves formed of a wear-resistant material often lack flexibility. The present invention provides a glove that is flexible and at the same time wear-resistant. Selected areas of the glove have internal resilient pads designed to protect the wearer's hand against scrapping or rubbing on external surfaces so as to injure or cut the person's skin.

In one embodiment of the invention, the glove body comprises a front panel adapted to fit against the palm of the wearer's hand, a second rear panel adapted to fit against the rear surface of the wearer's hand, and a third panel adapted to fit against front surfaces of the wearer's fingers. The third panel comprises four finger sections and a transverse connector section for joining the third panel to the aforementioned front panel).

Side edges of the finger sections on the third panel have sinuous configurations, that provide narrow panel areas in contact with hinge points on the person's fingers, whereby the third panel has sufficient flexibility to readily bend with the fingers. The third panel is preferably formed of cowhide or suede having a thickness of about 0.015 inch, whereby the front surfaces of the glove finger sections have good gripping properties and good wear resistance.

The third finger panel is formed separately from the first front panel so that different thickness materials can be used for the finger areas and palm areas of the glove body. A relatively thin cowhide or suede material is used for the finger panel, such that finger sections of the glove are easily flexed, while achieving a good gripping action on the bicycle handlebar. The transverse connector section on the finger panel provides a strong wear-resistant connection between the finger sections and the palm area of the glove body; this feature contributes to a glove body having a relatively long service life.

The palm area of the glove body has a generally circular resilient pad located on the internal surface of the glove body front panel. The resilient pad forms a resilient cushion that protects the palm of the wearer's hand from excessive pressure when the gloved hand has a grip on the handlebars of a bicycle. The resilient pad would offer similar protection for the gloved hand of a baseball player or golfer.

Facing surfaces of the glove body thumb and first finger sleeve have protective coverings, formed of cowhide or suede, whereby such facing surfaces are protected against premature wear.

Knuckles and hinge joints on the rear surface of the wearer's hand are protected against abrasion or scrapping by means of resilient pads located on the inner surfaces of the glove body rear panel. There are two pads for each finger sleeve section of the glove body. The pads are sized and located to protect the knuckles and hinge points on the hand, without interfering with normal hinge actions of the person's fingers.

Further features of the invention will be apparent from the attached drawings and description of a preferred embodiment of the invention.

BRIEF DESCRIPTION OF THE DRAWING

FIG. 1 shows a left glove. The companion right glove (not shown) is a mirror image of the glove shown in FIG. 1.

FIG. 3 is taken on an enlarged scale to show the relationship between the person's finger and selected areas of the glove body.

DESCRIPTION OF A PREFERRED EMBODIMENT OF THE INVENTION

Figure 1:
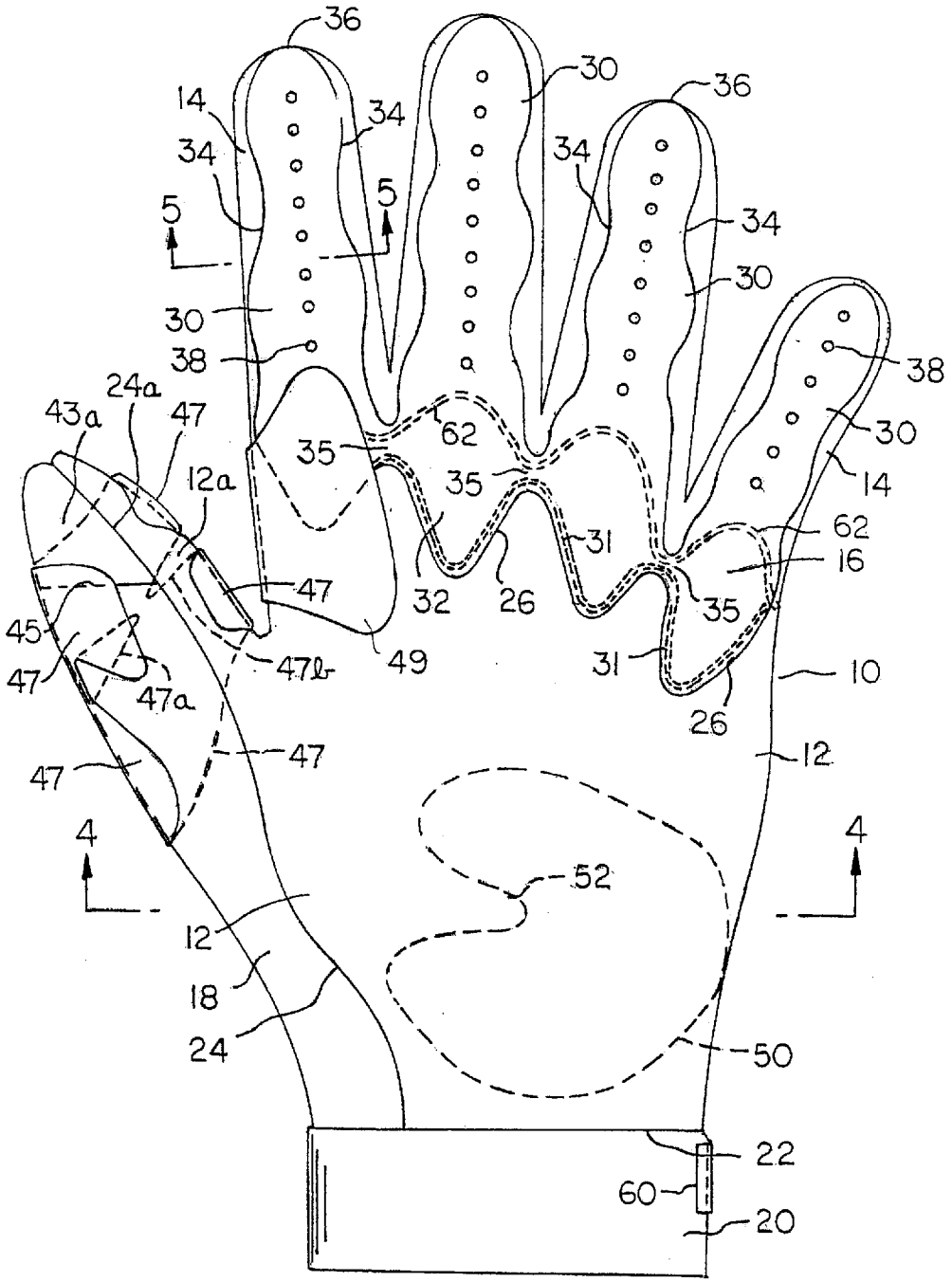
FIG. 1 is a front view of a glove body embodying the invention, looking toward the palm area and front surfaces of the glove thumb and glove fingers.

The drawings show major features of a bicyclist glove embodying the present invention. The glove body 10 is comprised of a first fabric front panel 12, a second fabric rear panel 14, and a third fabric panel 16 joined to panels 12 and 14. The glove body further includes a fourth thumb panel 18 joined to edge areas of panels 12 and 14. An elastic wrist band 20 is joined to end edges of panels 12 and 18.

Fabric panel 12 is preferably formed of a flexible suede material having a thickness of about 0.025 inch. Such a material is relatively flexible and at the same time wear resistant. Panel 12 has an end edge 22 joined to elastic wrist band 20, a left edge 24 joined to thumb panel 18, and a wave-like edge 26 joined to fabric panel 16. Panel 12 has an additional side edge 28 joined to rear panel 14. Joinder of the various panel edges is preferably accomplished by straight stitching performed with the glove body panels turned inside out. With the exception of stitching 31, the stitching is not visible in the finished glove body.

Fabric panel 16 is preferably formed of a flexible suede or rough surfaced cowhide material having a thickness of about 0.015 inch. The panel 16 material is thus somewhat thinner and more flexible than the panel 12 material. Panel 16 preferably has a roughened surface that facilitates a good gripping action on the bicycle handlebars or other object in the grasp of the glove.

Panel 16 comprises four elongated finger sections 30 extending integrally from a transverse connector section 32. Connector section 32 has a wave-shaped edge that overlaps and conforms to the wave edge 26 on front panel 12. The mating wave edges are joined together by straight double row stitching 31. The stitched edge area of panel 12 underlies the conforming edge 26 on panel 16.

Figure 3:
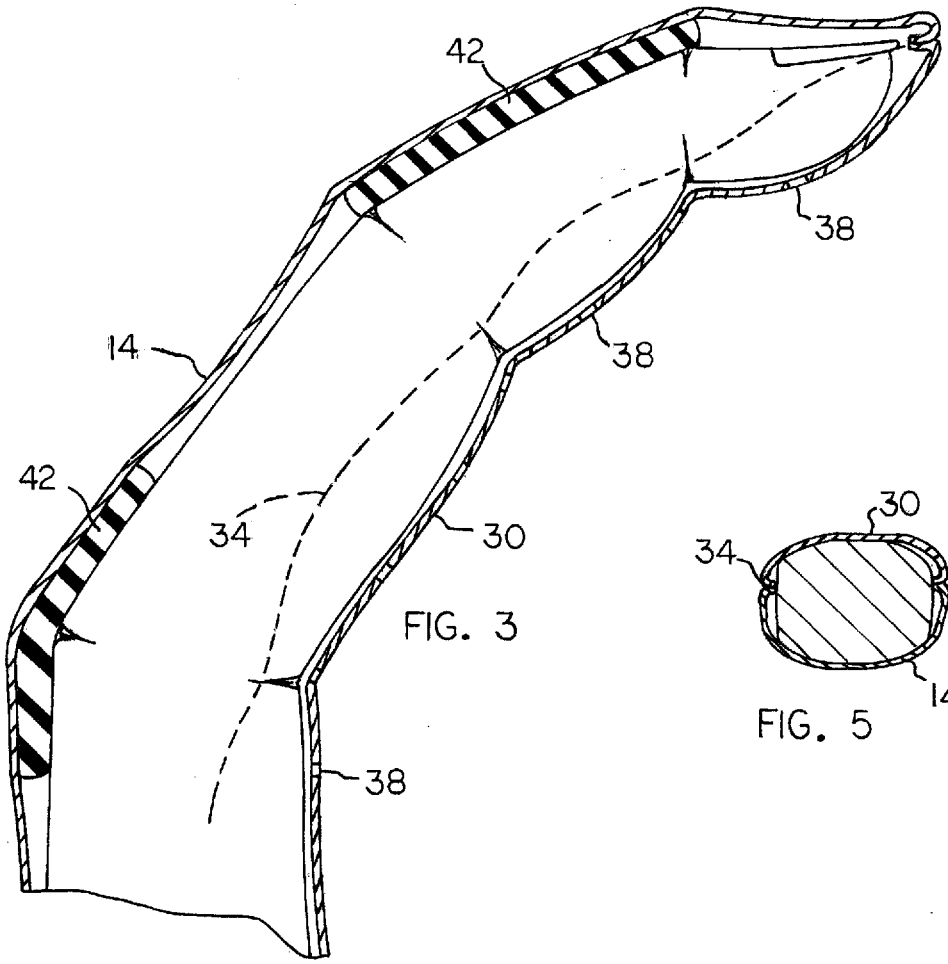
FIG. 3 is a longitudinal sectional view taken through a finger-enclosing section of the FIG. 1 glove body.

Each elongated finger section 30 has two side edges 34 and an interconnecting curved tip 36. Each side edge has a sinuous configuration that forms three relatively wide face areas and two intervening narrow face areas. When the glove is worn on a person's hand the two narrow face areas of each finger section 30 register with hinge points on the person's finger. Such a relationship facilitates flexure of panel 16 at the hinge points along the person's finger. FIG. 3 shows an illustrative finger sleeve structure flexed or hinged at points proximate to the hinge points on the person's finger.

The use of two separate panels 12 and 16 to form the front surfaces of the glove is advantageous in that the finger section 30 can be formed of a lighter (thinner) material than the palm arm (formed by panel 16). This improves the gripping action and mobility of the finger areas. Connector section 32 of panel 16 spans the entire width dimension of the glove body so as to have a relatively strong connection between finger sections 30 and panel 12. Finger sections 30 can readily flex relative to transverse connector section 32. The edge area of connection section 32 that is joined to panel 12 is scalloped to promote flexure of finger sections 30 (by enabling the flexural motions of finger sections 30 to continue into bridge areas 35 of connector section 32).

Rear panel 14 is formed of an open weave net material that is readily flexed, e.g. when the person curls his hand around a bicycle handlebar. openings in the net material provide escape paths for moisture generated on the skin of the person's hand during vigorous bicycle pedaling operations. Additionally, a row of vent openings 38 on each finger section 30 of panel 16 allow moisture to escape from the person's fingers.

Figure 5:
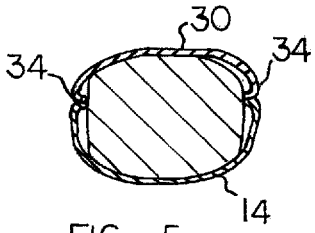
FIG. 5 is a fragmentary transverse sectional view taken on line 5—5 in FIG. 1.

Panel 14 is formed of four elongated strips of net material joined together along internal stitch lines 40. These elongated strips extend outwardly along finger sections 30 of panel 16, so as to complete the four finger sleeves of the glove body. Edge areas of the elongated strips are stitched to the sinuous side edges 34 and tip 36 of each finger section 30. As shown best in FIG. 5, each finger-enclosing sleeve has a wear-resistant fabric 30 fitting against the front surface of the person's finger, and an open weave net material 14 encircling the remaining surfaces of the person's finger. Each of the four finger-enclosing sleeves is generally the same construction, the primary difference being the sleeve length. The four finger-forming sections of rear panel 14 are detached from each other as peninsular extensions from the main area of panel 14. Since panel 14 is readily flexible the four finger sections have very good flexibility.

Figure 2:
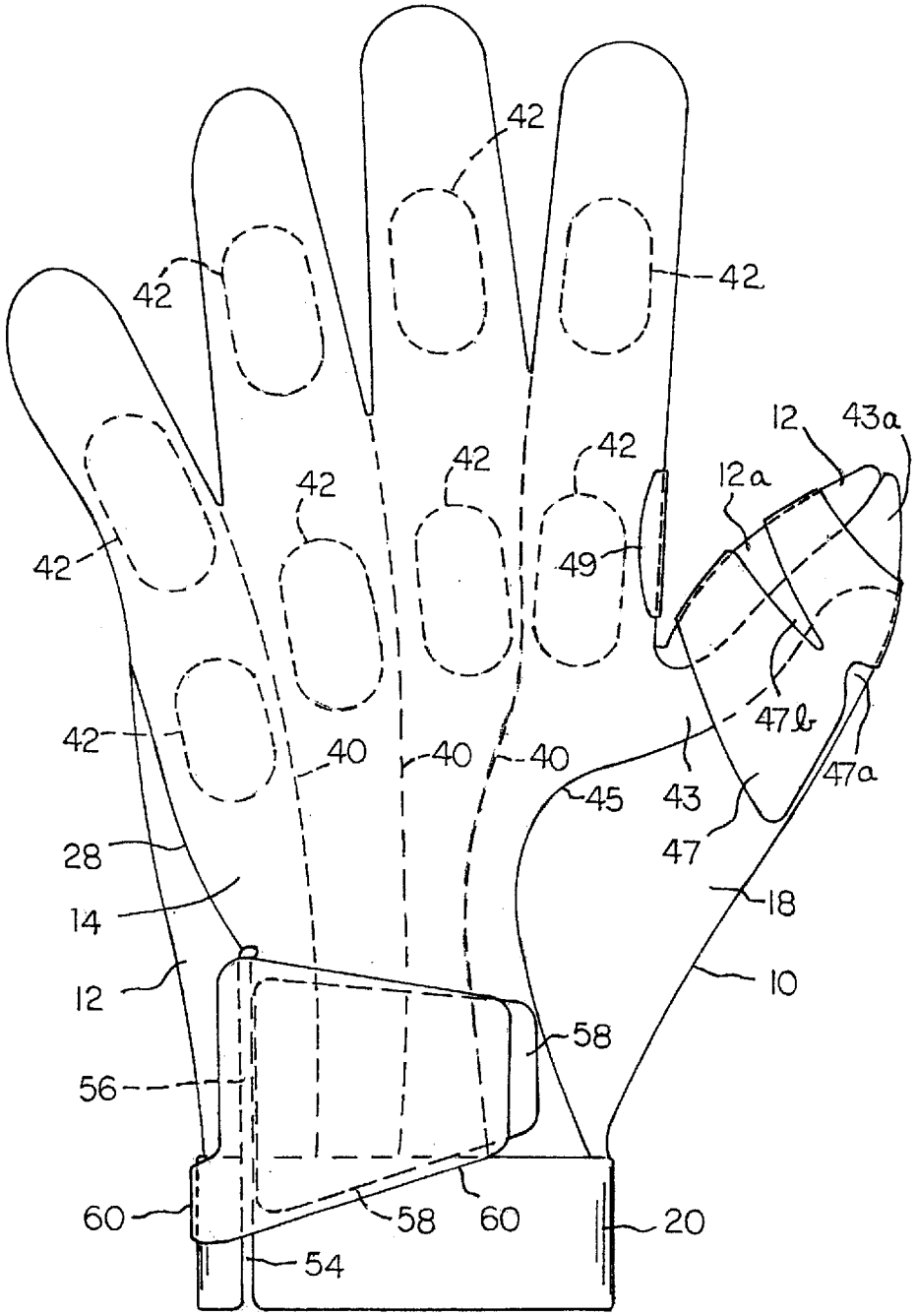
FIG. 2 is a rear view of the FIG. 1 glove body, looking toward the rear surface of the glove.

In order to protect the person's knuckles and back surfaces of the finger joints, the rear panel 14 is provided with eight resilient pads 42. Each pad is formed of a resilient elastomeric sheet material having a thickness of about 0.05 inch. As shown in FIG. 2, each resilient pad has rounded edges, such that the pad has a generally oval configuration. Each resilient pad 42 is stitched to the inner surface of rear panel 14.

The eight resilient pads 42 comprise four outer pads located on peninsular areas of the rear panel 14 near the tip of each finger enclosing sleeve, and four inner pads located remote from the tip of each finger-enclosing sleeve. As shown best in FIG. 3, a representative outer pad 42 spand two outer hinge points on the finger of the wearer's hand. The representative inner pad 42 overlaps the knuckle hinge point on the wearer's hand. The two resilient pads cooperatively shield the back surface of the hand from abrasive injury or impact injury, without adversely affecting glove flexibility.

As seen in FIG. 2, rear panel 14 includes an extension 43 that partially defines the thumb sleeve of the glove body. Extension 43 includes a section 43*a* that overlies the thumbnail on the person's thumb so as to provide ventilation for the thumb. Section 43*a* is joined to front panel 12 at stitch line 24*a* that is a continuation of joinder line (edge) 24.

Thumb panel 18 can be a woven cloth material having a relatively great thickness, e.g. about 0.03 inch. Panel 18 extends around the thumb area below section 43*a* so as to form a bridge between front panel 12 and rear panel 14. One edge of panel 18 is joined to edge 24 of panel 12; another edge of panel 18 is joined to edge 45 of panel 14. A principal purpose for panel 18 is to improve the fit of the glove body on the wearer's hand. The separate panel 18 can be configured to fit the fleshy area of the person's hand along the thumb in a better manner than would be possible by extending panels 12 and 14.

As shown in FIGS. 1 and 2, panel 12 includes a section 12*a* that partially defines the thumb sleeve of the glove body. Panel section 12*a* overlies the front surface of the person's thumb to provide a wear-resistant surface where the thumb applies pressure to a bicycle handlebar or other object. Additional wear-resistance is provided by a protective patch-type covering 47 that extends partially around the thumb sleeve of the glove body. Covering 47 is preferably formed of the same material as panel 16.

In order to maintain a desired flexibility to the thumb sleeve, covering 47 has side edge areas thereof notched, or indented, as at 47*a* and 47*b*. Notches 47*a* and 47*b* are located on the thumb sleeve so as to register with the hinge plane of the person's thumb. The bridge area of covering 47 between notches 47*a* and 47*b* is located along a side surface of the person's thumb so that the thumb can flex around its normal hinge joint without interference by wear-resistant covering 47.

An additional patch-like covering 49 is provided on the surface area of the glove body proximate to the knuckle of the person's first finger. Covering 49 can be formed of the same material that is used for panel 16. As shown in FIG. 1, wear-resistant patch 49 extends along the front surface of the glove body. However, the patch also extends around the edge surface of the glove body to a point near the first knuckle on the person's hand.

Wear-resistant patches 47 and 49 are in opposed relation. such that when the person grasps a bicycle handlebar or other object the two patches will be in pressure contact with the handlebar. These patches provide desired wear resistance without adversely affecting glove flexibility. Patches 47 and 49 may be affixed to the glove body by straight stitching performed after the various panels 12, 14, 16 and 18 have been stitched together to form the glove body.

During bicycle operation the palm area of the glove body exerts considerable pressure on the bicycle handlebar. In order to cushion the person's hand against such pressures the glove body is equipped with an interior resilient pad 50. As shown in FIG. 1. pad 50 has a circular configuration so that the pad covers the heel area and central area of the person's palm. The pad has a V-shaped indentation (or notch) 52 facing the thumb area of the glove body. This indentation allows the fleshy area of the palm aligned with the thumb to puff (or expand) without unduly distorting or stressing pad 50. The pad tends to retain its facial engagement with the palm surface without buckling.

Figure 4:
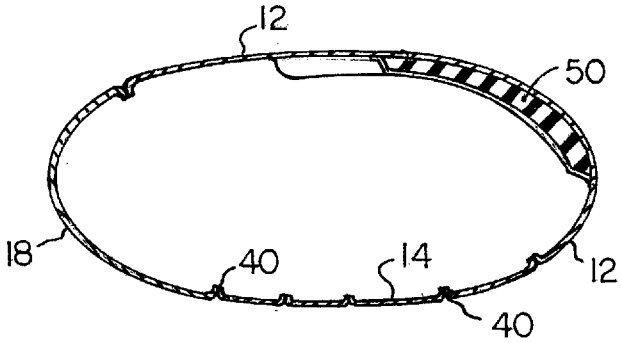
FIG. 4 is a transverse sectional view taken on line 4—4 in FIG. 1.

Pad 50 is formed of an elastomeric sheet material having a thickness of about 0.09 inch. The pad can have a thin cloth covering as shown in FIG. 4, to facilitate attachment of the pad to the inner surface of front panel 12.

As an optional feature, the glove body can be equipped with a tension device to ensure a tight fit of elastic band 20 on the wearer's wrist. The wrist band has a slit 54, whereby the elastic band has a discontinuous C-shaped cross-sectional character. The slit is continued upwardly in the glove body, as at 56 (in FIG. 2), such that the rear surface of the glove body is separated into two unconnected sections proximate to elastic band 20. Slit 56 has a length of about one and one half inch. The width dimension of elastic band 20 can be about one inch, such that the combined length of slits 54 and 56 is about two and one half inch, in an illustrative glove body construction.

To apply a tension (tightening) force to the elastic band 20 the glove body is equipped with mating patches of adhesive material on the separated sections of the glove body. These mating patches are preferably formed of fibrous interlocking surface materials available commercially under the trade-name VELCRO. A first stationary adhesive patch 58 is secured to rear panel 14 and a portion of band 20. A second movable adhesive patch 60 is secured to front panel 12 and a portion of band 20 separated from the mounting area for patch 58. Patch 60 overhangs the glove area occupied by patch 58 such that patch 60 can be drawn rightwardly (in FIG. 2) and locked against the fibrous surface of patch 58. Patches 58 and 60 can be locked in selected positions of adjustment to adjust the fit of elastic band 20 on the wearer's wrist.

The illustrated glove body is designed especially for use by bicyclists. Features of special interest are increased glove flexibility, wear resistance, and glove ventilation.

Finger panel 16 includes a connector section 32 and four elongated finger sections 30. Each finger section has two sinuous side edges 34 that form narrow areas in registry with the hinge joints on the wearer's finger, whereby the finger sections 30 can readily flex with the person's fingers. Rear panel 14 is formed of an open weave net material that provides flexibility and ventilation.

By separating the front surface of the glove body into two separate (but connected) panels 12 and 16, it is possible to achieve a desired combination of glove flexibility and wear-ability. Finger sections 30 are relatively thin and flexible. Connector section 32 provides a tear-resistant transition between finger sections 30 and main front panel 12.

Resilient pads 42 provide abrasion protection for the knuckles and joints on the back surfaces of the wearer's fingers. The pads are strategically located so as to permit flexure of the glove finger sections. Wear-resistant patches 47 and 49 are provided on opposed areas of the thumb and first knuckle, whereby the wearer can grasp a handlebar or other object without prematurely wearing out the glove.

A resilient palm pad 50 is provided to absorb and distribute pressures imposed on the palm area of the person's hand during normal bicycle riding activities. An indentation 52 in the pad enables the pad to seal flat against the palm areas of the wearer's hand during flexural motion of the thumb.

The glove body is formed out of separate flexible panels 12, 14, 16 and 18, whereby the glove body has a relatively good fit on the wearer's hand. The wearer's hand can flex without undue resistance from the glove body. As an optional feature, panel 16 can have two rows of sinuous stitches 62 along the demarcation line between connector sections 32 and finger sections 30. Stitching 62 facilitates flexure of finger sections 30 and conformability of connector section 30 to the person's hand surfaces.

As noted previously, the glove is intended especially for use by bicyclists. However it could also be used for other purposes, e.g. as a baseball (batting) glove or golfer's glove. The glove body has an advantageous combination of features, including good flexibility, ventilation, wear resistance, cushion ability, and abrasion protection. The glove can be manufactured in right hand and left hand versions (or pairs).

What is claimed:

1. A glove comprising:

a hollow flexible glove body that includes a first front panel adapted to fit against the palm of the wearer's hand, a second rear panel adapted to fit against the rear surface of the wearer's hand containing the metacarpal bones and the rear surfaces of the fingers on the wearer's hand, and a third panel adapted to fit against the front surfaces of the fingers on the wearer's hand;

said third panel comprising four finger sections and a transverse connector section integral with said four finger sections; said connector section being joined to said front panel;

each said finger section having two side edges joined to said second panel to form a hollow sleeve adapted to encircle an individual finger of the wearer's hand;

the side edges of each said finger section having sinuous configurations, whereby each finger section has two relatively narrow face areas adapted to register with hinge points on the finger of the wearer's hand.

2. The glove of claim 1, wherein said third panel is formed of a material selected from the group consisting of cowhide and suede; said third panel having a thickness of about 0.015 inch.

3. The glove of claim 1, wherein each said finger section has a row of air vent openings located midway between the finger section side edges.

4. The glove of claim 1, wherein said third panel is formed of a material selected from the group consisting of cowhide and suede; said third panel having a thickness of about 0.015 inch; each said finger section having a row of air vent openings located midway between the finger section side edges.

5. The glove of claim 1, wherein said second rear panel has a first area adapted to fit against the rear surface of the wearer's hand and spaced peninsular areas extending from said first area to lie against rear surfaces of the wearer's hand; and two resilient pads affixed to each said peninsular area; the resilient pads on each said peninsular area being spaced apart so as to overlie hinge points on the finger of the wearer's hand.

6. The glove of claim 5, wherein each resilient pad is formed of an elastomer having a thickness of about 0.05 inch.

7. The glove of claim 5, wherein each resilient pad has an oval configuration.

8. The glove of claim 5, wherein the two resilient pads on each said peninsular area comprise a first pad located near the tip of the peninsular area and a second pad located remote from the tip of the peninsular area; each said first pad being adapted to span two hinge points on the finger of the wearer's hand; each said second pad being adapted to overlap a different hinge point on the wearer's hand.

9. The glove of claim 1, and further comprising a fourth thumb panel joined to said front panel and said rear panel; said thumb panel being sized to extend around portions of the front and rear surfaces of the wearer's hand between the thumb and wrist.

10. The glove of claim 9, and further comprising an elastic wrist band joined to edge areas of said front panel, rear panel, and thumb panel.

11. The glove of claim 1, and further comprising a resilient palm pad affixed to said front panel.

12. The glove of claim 11, wherein said palm pad is formed of an elastomer having a thickness of about 0.09 inch.

13. The glove of claim 11, wherein said palm has a configuration that is essentially a circle having a V-shape notch presented to the thumb area of the glove front panel.

14. The glove of claim 1, wherein said glove body comprises a sleeve adapted to enclose the thumb of the wearer's hand; and a wear-resistant protective covering partially encircling said thumb sleeve.

15. The glove of claim 14, wherein said wear-resistant protective covering has two opposed side edges, each side edge of said protective covering having a notch therein adapted to overlie a hinge point on the thumb of the wearer's hand.

16. The glove of claim 14, and further comprising a second wear-resistant protective covering on the surface of the finger-encircling sleeve proximate to said thumb sleeve; said second protective covering being adapted to register with said first-mentioned protective covering when the hand of the wearer is curled into a fist configuration.

17. The glove of claim 1, wherein said rear panel is formed of a flexible open weave net material.

18. The glove of claim 1, wherein said transverse connector section has a scalloped edge stitched to said front panel; said scalloped edge forming reduced width bridges across the finger sections, whereby flexural motions of the finger sections continue into said connector section.

* * * * *